US006089128A

United States Patent [19]

Kopyless

[11] Patent Number: 6,089,128

[45] Date of Patent: Jul. 18, 2000

[54] WRENCH FOR INACCESSIBLE FASTENER

[76] Inventor: Patrick Kopyless, 4120 SW. 38th St., Hollywood, Fla. 33023

[21] Appl. No.: 09/166,411

[22] Filed: Oct. 5, 1998

[51] Int. Cl.[7] ..... B25B 13/06

[52] U.S. Cl. ..... 81/124.7; 81/177.2

[58] Field of Search ..... 81/124.7, 124.3, 81/121.1, 177.1, 177.2, 177.9, 177.5, 177.7; D8/17

[56] References Cited

U.S. PATENT DOCUMENTS

| | | | |
|---|---|---|---|
| D. 60,270 | 1/1922 | Shedd | 81/177.5 |
| 471,539 | 3/1892 | Everitt . | |
| 807,637 | 12/1905 | Pipkin . | |
| 1,316,398 | 9/1919 | Steininger | 81/177.7 X |
| 1,464,132 | 8/1923 | Haggardt | 81/124.3 |
| 1,512,559 | 10/1924 | Moore | 81/177.1 X |
| 3,039,339 | 6/1962 | Hanson | 81/177 |
| 5,230,263 | 7/1993 | Kwaka | 81/125.1 |

OTHER PUBLICATIONS

BAHCO, catalog No. 1/86 US, pp. 8–11.

Engine Mount: Service and Repair Instructions 1986 Cadillac Seville V8–252 4.1L (All Data 1997).

*Primary Examiner*—D. S. Meislin

*Attorney, Agent, or Firm*—Alvin S. Blum

[57] ABSTRACT

A tool is provided for removing and replacing an engine mount in a vehicle that can fit between an air conditioning compressor and the upstanding stud on the engine mount to unscrew the nut on the stud and remove and replace the engine mount without removing other components from the vehicle. The tool has an elongate shaft with a transverse handle at one end and a transverse member at the other end fitted with a thin twelve point closed box end wrench head.

6 Claims, 3 Drawing Sheets

WRENCH FOR INACCESSIBLE FASTENER

BACKGROUND OF THE INVENTION

This invention relates to hand tools for turning threaded fasteners, and more particularly to a box wrench for engaging and turning hexagonal nuts and bolts in motor vehicle areas that are ordinarily inaccessible without removing overlying elements such as air conditioning compressors. U.S. Pat. No. 5,230,263 issued Jul. 27, 1993 to Kwaka discusses and reviews the prior art of wrenches and discloses a new wrench that would not resolve the problems the instant invention is intended to overcome. There are certain motor vehicles in which the engine compartment is so crowded with components that access to other elements that must be replaced can only be achieved by first removing the overlying components.

This is the situation that confronts the mechanic who must replace the engine mounts in certain vehicles such as: the front wheel drive Cadillac V8-273-4.5L and the Cadillac Seville 1986 V8-252-4.1L. One of the engine mounts is beneath the air conditioning compressor. In order to remove and replace a defective engine mount, the hexagonal 15 mm nut that secures the upstanding engine mount stud to a bracket bolted onto the engine must be removed. The recommended procedure is quite elaborate, an is estimated by the manual to require 3.1 hours of labor. It involves discharging and removing an overlying air conditioner compressor, removing ground cable, serpentine belt, shields, and removing the bracket from the engine. The engine is then raised and the mount can be unbolted from the frame and removed with the bracket. The bracket is then removed from the mount by removing the hexagonal nut from the stud and a new mount is bolted to the bracket and the entire process reversed. Not only does this take long time, but there is always the possibility of causing damage to any one of the various elements that have been disturbed in the process, and they must also be tested.

If the nut could be removed from stud without disturbing the other components in the engine compartment, the time required to remove and replace the engine mount could be greatly reduced, and inadvertent damage to other components avoided.

SUMMARY OF THE INVENTION

It is accordingly an object of the invention to provide a hand tool that can effectively remove and replace the nut on the engine mount stud without disturbing any other components in the engine compartment including the air conditioning compressor so that the engine mount can be removed and replaced. The hand tool of the invention comprises a twelve point box wrench for a 15 millimeter nut on the end of a bar attached at a downwardly sloping angle to a vertical shaft that extends downwardly about eighteen inches to terminate in a wrench handle or adapted to receive a wrench handle. The tool is so configured that it can be inserted from below the frame, through a space between a longitudinal frame member and the engine and inserted between the overlying components and the nut. In order to fit into this space, the box end must be thinner than conventional wrenches. The box end is then lowered onto the nut and the nut turned by use of the wrench handle. The engine bracket estricts the angle through which the wrench can swing. Being a 12 point box wrench working on a hexagonal nut, the wrench must be able to swing through at least 30° in order to remove the nut in successive motions. By extending the box end away from the vertical shaft by a center to center distance of about 2 inches, the tool can move the nut through an angle of at least 30° without interference from the bracket. The sloping connection from box to shaft keeps the shaft free of obstructions at the engine.

These and other objects, advantages and features of the invention will become more apparent when the detailed description is studied in conjunction with the drawings, in which like characters designate like elements in the various figures.

DETAILED DESCRIPTION OF PREFERRED EMBODIMENTS

Figure 1:
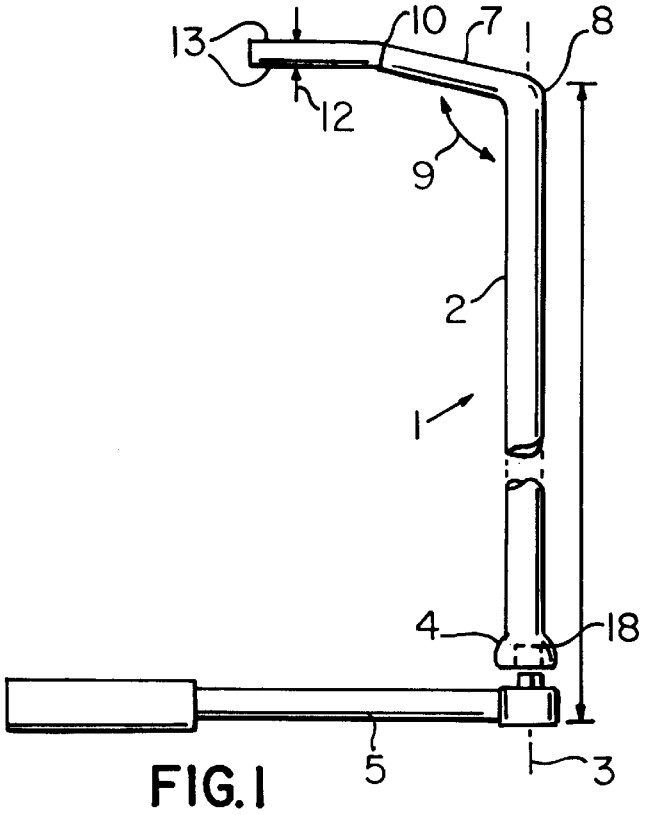
FIG. 1 is a side elevation view of the tool of the invention.
Figure 2:
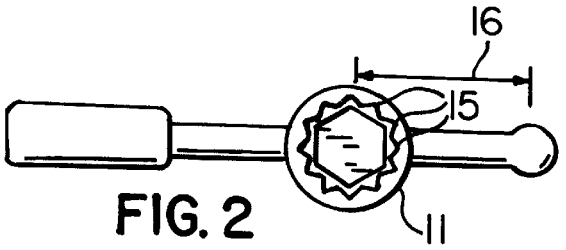
FIG. 2 is a top view of the tool.

Referring now first to FIGS. 1 and 2, the tool 1 comprises an elongate shaft 2 with a long axis 3. Shaft 2 has a first extremity 4 to which is removably attachable ratchet handle 5 that has a ⅜ inch square male connector 17 for engaging a similarly configured female recess 18 in extremity 4. A transverse member or bar 7 is fixedly attached to a second extremity 8 of shaft 2 at an angle 9 of between about 100° to 120° and preferably about 100° to long axis 3. At the free end 10 of bar 7 is affixed a closed end box wrench head 11 with twelve points or angular apices 15. The center to center distance 16 between head 11 and shaft 2 is between about 1.75 and 2.25 inches and preferably about two inches. The head 11 has substantially planar top and bottom faces 13 that are spaced apart by a distance 12 of less than 0.25 inches and preferably between 0.15 and 0.25 inches. The angle between the planar faces 12 of the head and the long axis 3 is between about 87° and 90°.

Figure 3:
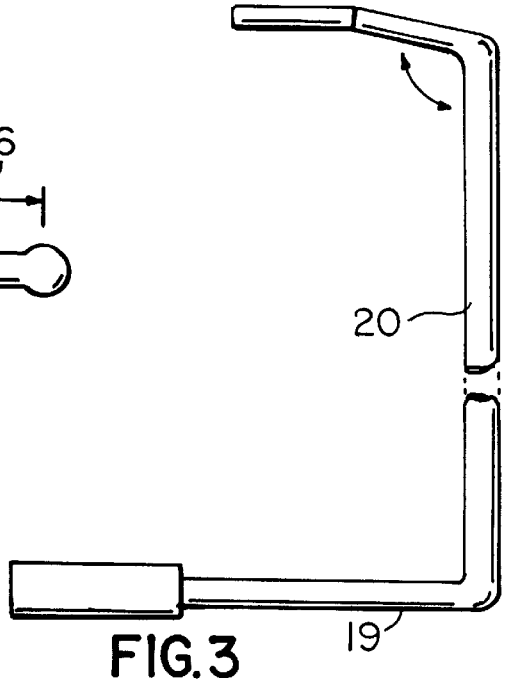
FIG. 3 is a side elevation view of an alternative embodiment of the tool having a fixed handle.

As shown in FIG. 3, the handle 19 may be fixedly attached to elongate shaft 20 or formed in one piece therewith.

The length of the elongate shaft 2 or 20 may be from about 8 inches to 25 inches and preferably about 18 inches.

METHOD OF APPLICATION

Figure 4:
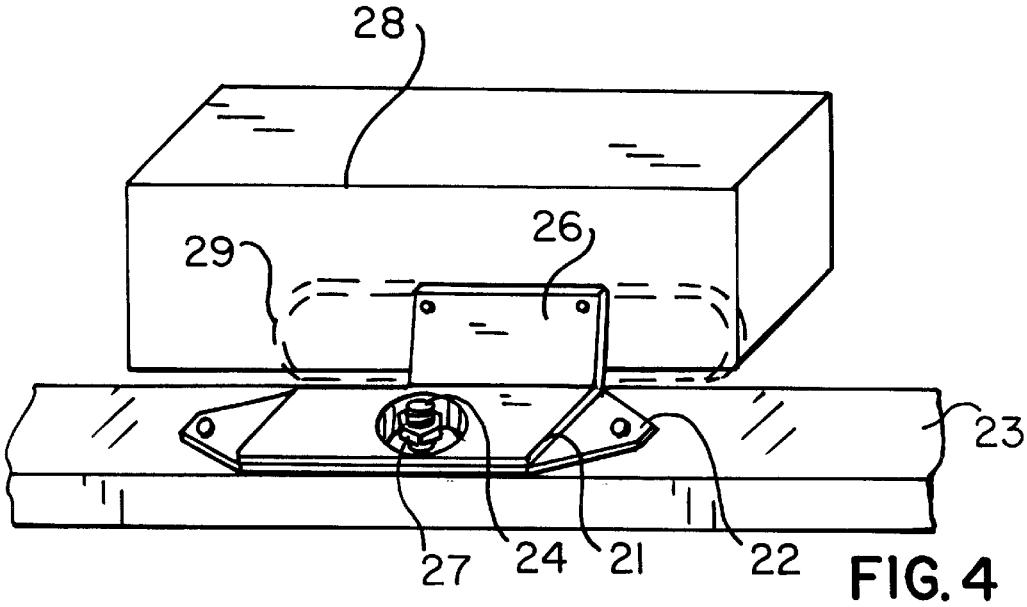
FIG. 4 is a diagrammatic perspective view of portions of a vehicle to which the tool is to be applied.
Figure 5:
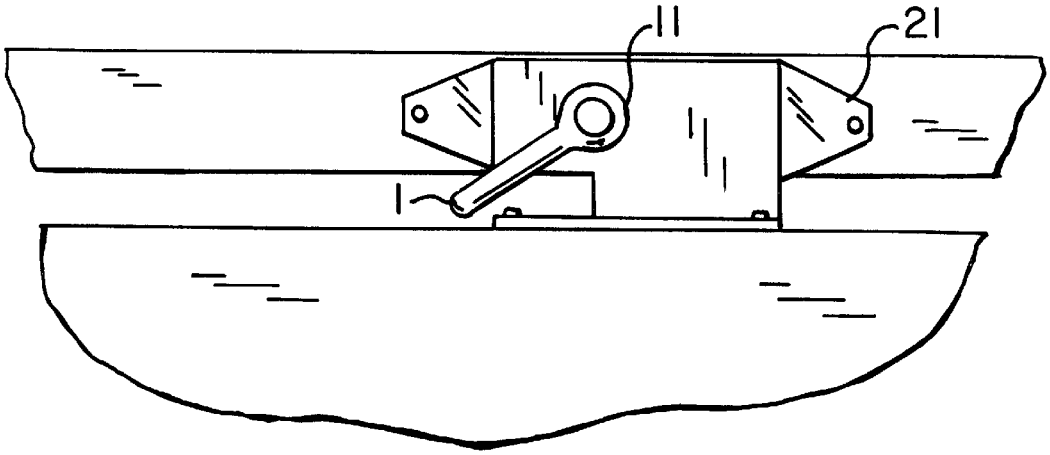
FIG. 5 is a diagrammatic top view of portions of a vehicle to which the tool is to be applied.
Figure 6:
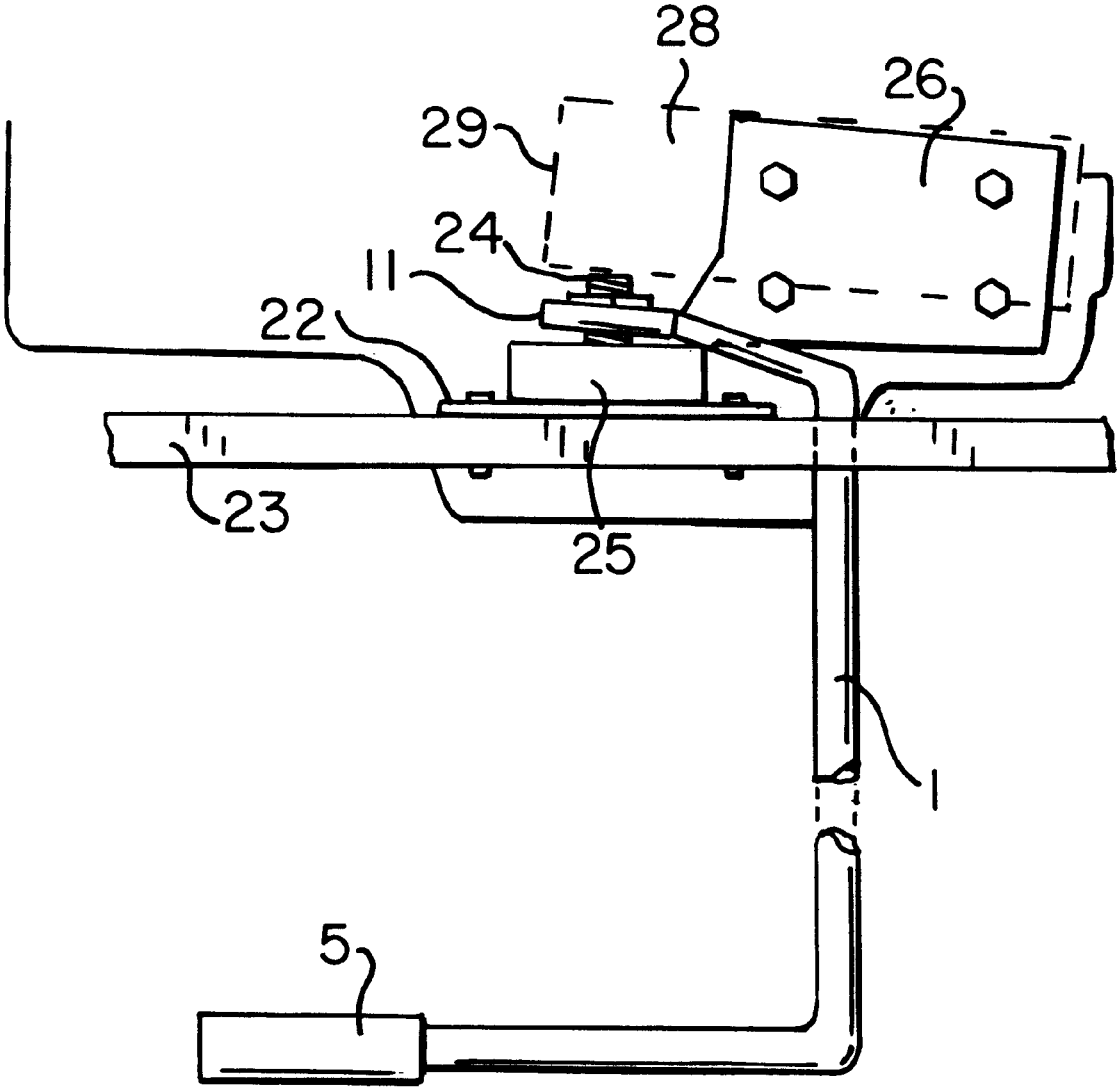
FIG. 6 is a diagrammatic side view of portions of a vehicle to which the tool is to be applied.

Referring now to FIGS. 4–6, the motor mount 21 has a metal base 22 bolted on top of frame member 23. A threaded stud 24 is upstanding from a rubbery cushion 25 that isolates the engine from the frame. A bracket 26 that is bolted to the engine block 28 is mounted onto stud 24 and secured with a hexagonal nut 27. Heat and stress may cause the cushion 25 to deteriorate. The engine then is partially loose from the frame which degrades vehicle performance, and it becomes necessary to replace the engine mount. In some vehicles this is a very difficult and time consuming task, because the engine compartment is so crowded that it is not possible to access the hex nut 27 with conventional tools unless many components, such as the air conditioning compressor 29 (shown in phantom in FIGS. 4 and 6) are first removed. There is a possibility of causing damage to these components as well as the time and effort involved in their removal.

The accepted practice also requires removal of the bracket from the engine while lifting the engine and then removing the mount and bracket. Only then is the mount removed from the bracket, replaced with a new mount, and the entire process reversed.

The tool of the invention can be inserted from beneath the vehicle, with the head 11 passing beside the frame and then over the stud 24 and onto the hexagenal nut 27 above the portion of the bracket on the stud. The handle 5 is then rotated as far as possible, the head is lifted from the nut and the handle returned to its starting position, the head engaged on the nut and another rotation applied. Each rotation moves the nut through an angle of at least 30° so that the following rotation can continue. The angle and dimensions permit this operation to be performed without having to disconnect or remove any other components. When the nut is removed and the mount unbolted from the frame, the engine may be lifted, the mounted replaced, bolted to the frame, the engine lowered until the bracket fits onto the stud, and the nut screwed on with the tool. The head is thin enough to fit between the stud and an overlying compressor 29.

This tool enables the entire process to be done in less than an hour instead of more than three hours. And, becuase no other elements have been disturbed, there is less additional work to be done and less customer dissatisfaction from inadvertent damage to other components.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. For use in turning screw-threaded polygonal nuts and bolts having a polygonal head, a hand operable tool comprising:

A) an elongate shaft having a first extremity provided with a wrench handle means for rotating the shaft, the shaft having a long axis, and a length of at least 16 inches;

B) a transverse bar attached to a second extremity of the shaft and extending laterally from the shaft at an angle of between 100° and 110° to the long axis, the bar having a free end; and C) a closed-end box wrench head attached to the free end of the bar and having a major plane disposed at an angle to the long axis of about 89°, the wrench head having at least as many points or angular apices as the polygonal nut or bolt, and having a thickness of less than 0.25 inches, the center to center distance between the wrench head and the shaft being about two inches.

2. For use in turning a screw threaded hexagonal nut, a tool comprising:

A) an elongate shaft having a first extremity provided with, a wrench handle means for rotating the shaft, the shaft having a long axis and a length of between about 8 inches and 25 inches;

B) a transverse member attached to a second extremity of the shaft at an angle of between 100° and 120° to the long axis, the member having a free end; and C) a closed-end box wrench head attached to the free end of the member and having parallel planar faces disposed at an angle to the long axis of between 87° and 90°, the wrench head having twelve points or angular apices and having a thickness between the planar parallel faces of between 0.15 and 0.25 inches, the center to center distance between the wrench head and the shaft being between 1.75 inches and 2.25 inches.

3. The tool according to claim 1 in which the handle means comprises a rigid handle permanently affixed to the first extremity transverse to the long axis.

4. The tool according to claim 1 in which the handle means comprises means for removable attachment of a wrench handle transverse to the lone axis.

5. The tool according to claim 2 in which the handle means comprises a rigid handle permanently affixed to the first extremity transverse to the long axis.

6. The tool according to claim 2 in which the handle means comprises means for removable attachment of a wrench handle transverse to the long axis.

* * * * *